US010962306B2

(12) United States Patent
Disori et al.

(10) Patent No.: US 10,962,306 B2
(45) Date of Patent: Mar. 30, 2021

(54) SHAPED LEADING EDGE OF CAST PLATE FIN HEAT EXCHANGER

(71) Applicant: United Technologies Corporation, Farmington, CT (US)

(72) Inventors: Michael A. Disori, Glastonbury, CT (US); William P. Stillman, Sturbridge, MA (US); Adam J. Diener, Marlborough, CT (US); Alexander Broulidakis, Tolland, CT (US); David J. Hyland, Portland, CT (US); Jeremy Styborski, East Hartford, CT (US)

(73) Assignee: RAYTHEON TECHNOLOGIES CORPORATION, Waltham, MA (US)

( * ) Notice: Subject to any disclaimer, the term of this patent is extended or adjusted under 35 U.S.C. 154(b) by 75 days.

(21) Appl. No.: 16/271,178

(22) Filed: Feb. 8, 2019

(65) Prior Publication Data

US 2019/0293366 A1 Sep. 26, 2019

Related U.S. Application Data

(60) Provisional application No. 62/647,030, filed on Mar. 23, 2018.

(51) Int. Cl.

| | |
|---|---|
| ***F28F 3/00*** | (2006.01) |
| ***F28F 3/04*** | (2006.01) |
| ***F28D 9/00*** | (2006.01) |
| ***F28F 3/08*** | (2006.01) |
| ***F28F 9/02*** | (2006.01) |
| ***F28F 1/02*** | (2006.01) |
| ***F28F 1/26*** | (2006.01) |

(52) U.S. Cl.

CPC ..... *F28F 3/04* (2013.01); *F28D 9/0093* (2013.01); *F28F 1/025* (2013.01); *F28F 1/26* (2013.01); *F28F 3/08* (2013.01); *F28F 9/02* (2013.01); *F28F 2255/14* (2013.01)

(58) Field of Classification Search

CPC ..... F28F 3/04; F28F 1/025; F28F 1/26; F28F 3/08; F28F 9/02; F28F 2255/14; F28D 9/0093

USPC ..... 165/166

See application file for complete search history.

(56) References Cited

U.S. PATENT DOCUMENTS

| | | | |
|---|---|---|---|
| 2,325,036 | A | 7/1943 | Case |
| 4,171,015 | A | 10/1979 | Bucey et al. |

(Continued)

FOREIGN PATENT DOCUMENTS

| | | | |
|---|---|---|---|
| DE | 202004011489 | U1 | 12/2005 |
| EP | 0132237 | A2 | 1/1985 |
| EP | 2543946 | | 1/2013 |

OTHER PUBLICATIONS

European Search Report for EP Application No. 19164153.9 dated Sep. 13, 2019.

*Primary Examiner* — Davis D Hwu

(74) *Attorney, Agent, or Firm* — Carlson, Gaskey & Olds, P.C.

(57) ABSTRACT

A heat exchanger assembly includes a plate including a plate portion having a leading edge, a trailing edge, an inlet side and an outlet side. The leading edge of the plate portion includes a terminal tip and a varying radius that decreases in a direction toward the terminal tip. An inlet manifold is on the inlet side. An outlet manifold is on the outlet side. A cast plate for a plate fin heat exchanger is also disclosed.

16 Claims, 6 Drawing Sheets

(56) References Cited

U.S. PATENT DOCUMENTS

| | | | | |
|---|---|---|---|---|
| 5,251,692 | A | 10/1993 | Haussmann | |
| 8,997,941 | B2 | 4/2015 | Dawson | |
| 2004/0035562 | A1 | 2/2004 | Nishijima et al. | |
| 2013/0213624 | A1* | 8/2013 | Fujii | F28D 1/05375 165/173 |
| 2016/0320141 | A1* | 11/2016 | Barfknecht | F28D 9/005 |

* cited by examiner

SHAPED LEADING EDGE OF CAST PLATE FIN HEAT EXCHANGER

CROSS-REFERENCE TO RELATED APPLICATION

This application claims priority to U.S. Provisional Application No. 62/647,030 filed on Mar. 23, 2018.

BACKGROUND

A plate fin heat exchanger includes adjacent flow paths that transfer heat from a hot flow to a cooling flow. The flow paths are defined by a combination of plates and fins that are arranged to transfer heat from one flow to another flow. The plates and fins are created from sheet metal material brazed together to define the different flow paths. Thermal gradients present in the sheet material create stresses that can be very high in certain locations. The stresses are typically largest in one corner where the hot side flow first meets the coldest portion of the cooling flow. In an opposite corner where the coldest hot side flow meets the hottest cold side flow the temperature difference is much less resulting in unbalanced stresses across the heat exchanger structure. Increasing temperatures and pressures can result in stresses on the structure that can exceed material and assembly capabilities.

Turbine engine manufactures utilize heat exchangers throughout the engine to cool and condition airflow for cooling and other operational needs. Improvements to turbine engines have enabled increases in operational temperatures and pressures. The increases in temperatures and pressures improve engine efficiency but also increase demands on all engine components including heat exchangers.

Turbine engine manufacturers continue to seek further improvements to engine performance including improvements to thermal, transfer and propulsive efficiencies.

SUMMARY

In a featured embodiment, a heat exchanger assembly includes a plate including a plate portion having a leading edge, a trailing edge, an inlet side and an outlet side. The leading edge of the plate portion includes a terminal tip and a varying radius that decreases in a direction toward the terminal tip. An inlet manifold is on the inlet side. An outlet manifold is on the outlet side.

In another embodiment according to the previous embodiment, a plurality of fin portions extend outward from a top surface and a bottom surface of the plate portion. Each of the plurality of fin portions include a forward most end that is spaced apart from the terminal tip.

In another embodiment according to any of the previous embodiments, the forward lost end of each of the plurality of fin portions is tapered in a direction away from the terminal tip.

In another embodiment according to any of the previous embodiments, the plate portion includes a plurality of internal passages extending between a corresponding plurality of inlets on the inlet side and a corresponding plurality of outlets on the outlet side.

In another embodiment according to any of the previous embodiments, the plate portion includes a top surface parallel to a bottom surface, and the varying radius tapers from both the top surface and bottom surface at an intersection point spaced apart from the terminal tip and at least one of the plurality of passages is disposed at least partially forward of the intersection point.

In another embodiment according to any of the previous embodiments, a uniform wall thickness is included between each of the plurality of passages and the top and bottom surfaces of the plate portion.

In another embodiment according to any of the previous embodiments, one of the plurality of internal passages includes a leading edge passage disposed closest to the leading edge. The leading edge passage includes a width different than each of the other plurality of passages.

In another embodiment according to any of the previous embodiments, one of the plurality of internal passages includes a leading edge passage disposed closest to the leading edge. A wall thickness between the leading edge passage and the leading edge increases in a direction toward the terminal tip.

In another embodiment according to any of the previous embodiments, the plurality of passages are one of a stadium shape, elliptical shape, oval shape and rectilinear shape in cross-section.

In another embodiment according to any of the previous embodiments, the plate includes a plurality of plate portions extending between a common inlet face and a common outlet face. A cooling flow channel is disposed between two of the plurality of plate portions and includes fins extending from top and bottom surface of each of the plurality of plate portions.

In another embodiment according to any of the previous embodiments, the trailing edge includes a second terminal tip and a trailing edge surface with a varying radius that decreases in a direction toward the second terminal tip.

In another embodiment according to any of the previous embodiments, a trailing edge passage is disposed at least partially aft of an intersection point between the top and bottom surfaces and the trailing edge surface.

In another embodiment according to any of the previous embodiments, the plate includes a single unitary part.

In another featured embodiment, a cast plate for a plate fin heat exchanger includes a plate portion having a leading edge, trailing edge, an inlet side and an outlet side. The leading edge of the plate portion includes a terminal tip and a varying radius that decreases in a direction toward the terminal tip.

In another embodiment according to the previous embodiment, a plurality of fin portions extend outward from a top surface and a bottom surface of the plate portion. Each of the plurality of fin portions includes a forward most end that is spaced apart from the leading edge and tapered in a direction away from the terminal tip.

In another embodiment according to any of the previous embodiments, the varying radius tapers begin from at least one of a top surface and a bottom surface at an intersection point spaced apart from the terminal tip and at least one of a plurality of passages through the plate portion is disposed at least partially forward of the intersection point.

In another embodiment according to any of the previous embodiments, one of the plurality of passages includes a leading edge passage disposed closest to the leading edge. A wall thickness is between the leading edge passage and the leading edge increases in a direction toward the terminal tip.

In another embodiment according to any of the previous embodiments, the plurality of passages are one of a stadium shape, elliptical shape, oval shape and rectilinear shape in cross-section.

In another embodiment according to any of the previous embodiments, the cast plate includes a plurality of plate portions extending between a common inlet face and a common outlet face. A cooling flow channel is disposed between two of the plurality of plate portions and includes fins extending from top and bottom surface of each of the plurality of plate portions.

In another embodiment according to any of the previous embodiments, the cast plate includes a single unitary part.

Although the different examples have the specific components shown in the illustrations, embodiments of this disclosure are not limited to those particular combinations. It is possible to use some of the components or features from one of the examples in combination with features or components from another one of the examples.

These and other features disclosed herein can be best understood from the following specification and drawings, the following of which is a brief description.

DETAILED DESCRIPTION

Figure 1:
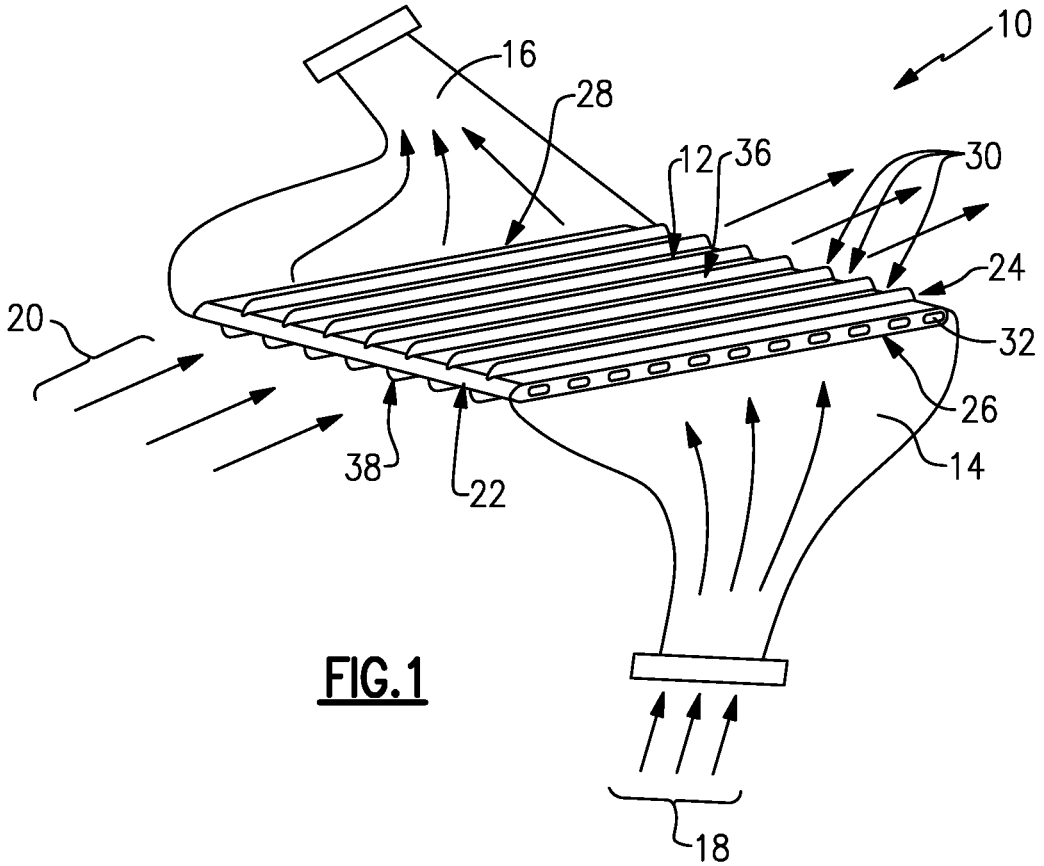
FIG. 1 is a schematic view of an example heat exchanger embodiment.

Referring to FIG. 1, an example heat exchanger 10 is schematically shown and includes a plate 12 that is attached at an inlet side 26 to an inlet manifold 14. An outlet manifold 16 is attached to an outlet side 28 of the plate 12. Incoming hot airflow 18 is communicated to a plurality of internal passages through the plate 12 through the inlet manifold 14. Cooled airflow exits through the outlet side 28 into the outlet manifold 16. A cooling airflow 20 flows over a top surface 36 and a bottom surface 38 of the plate 12. The top surface 36 and bottom surface 38 each include a plurality of fin portions 30. The fin portions 30 extend outward to provide additional surface area for the transfer of thermal energy between the hot flow 18 and the cooling flow 20.

The example plate 12 is a single cast unitary part including the fin portions 30 that extend from a plate portion 32. The plate portion 32 includes a leading edge 22 and trailing edge 24. The cooling airflow 20 initially encounters the plate 12 at the leading edge 22 and flows over the top and bottom surfaces 36, 38 toward the trailing edge 24. It should be appreciated that although one example plate 12 is disclosed as cast, other fabrication techniques and methods could be used, such a machining, and are within the contemplation of this disclosure.

Figure 2:
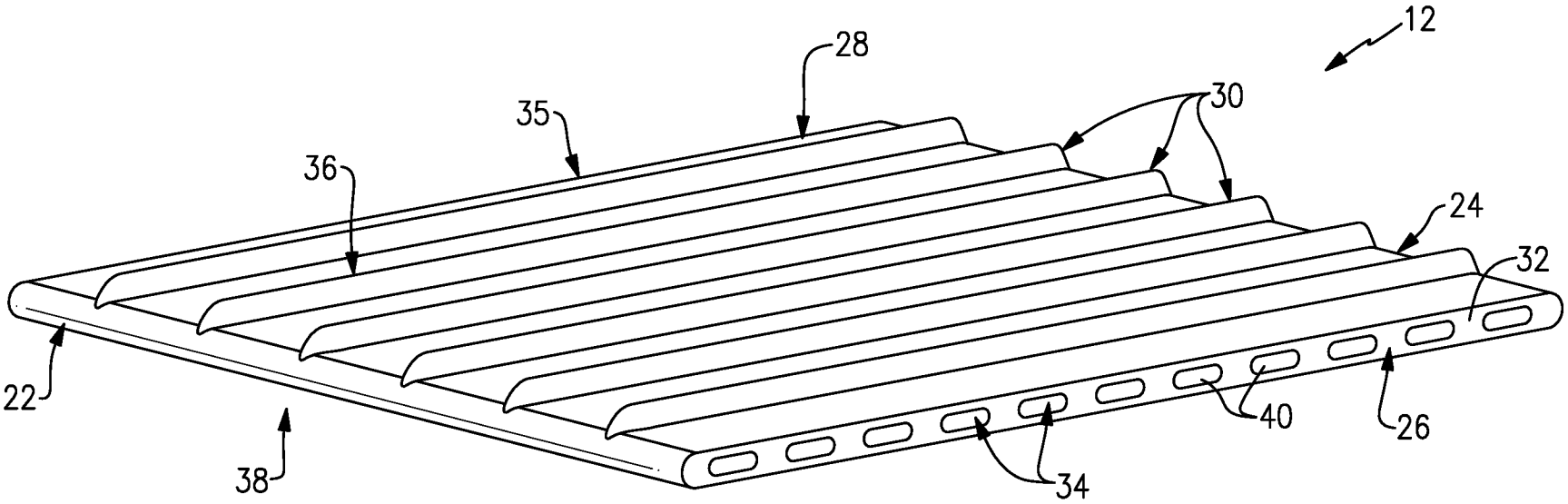
FIG. 2 is a perspective view of an example cast plate embodiment.
Figure 3:
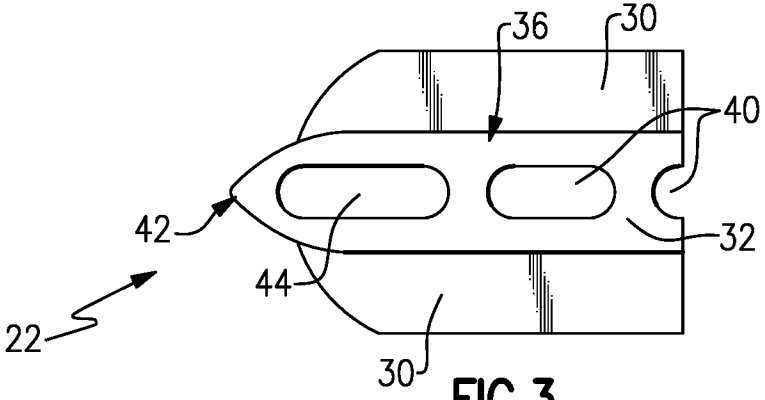
FIG. 3 is an enlarged view of a leading edge of the cast plate.

Referring to FIGS. 2 and 3 with continued reference to FIG. 1, the example the leading edge 22 includes a terminal tip 42. The terminal tip 42 is the extreme most leading edge portion of the plate 12 and is the first part to encounter the cooling airflow 20. The example leading edge 22 includes the terminal tip 42 and includes a configuration provided to increase durability and provide additional survivability in the event of impact by debris within cooling airflow stream 20.

The plate 12 includes the plurality of passages 40 that extend between a corresponding plurality of inlets 34 on the inlet side 26 to a corresponding plurality of outlets 35 on the outlet side 28. Each of the plurality of passages 40 extending through the plate portion 32 include a cross-sectional shape. In the disclosed example each of the passages includes a stadium shape in cross section. It should appreciated that each of the passages 40 may be of a different cross-section including oval, elliptical and rectilinear shapes in cross-section. Moreover other shapes as are known and provided in the art may also be utilized in or within contemplation of this disclosure. The leading edge 22 of the example plate portion 12 includes a leading edge passage 44 which has a different configuration than the other passages 40 through the plate portion 32.

Figure 4:
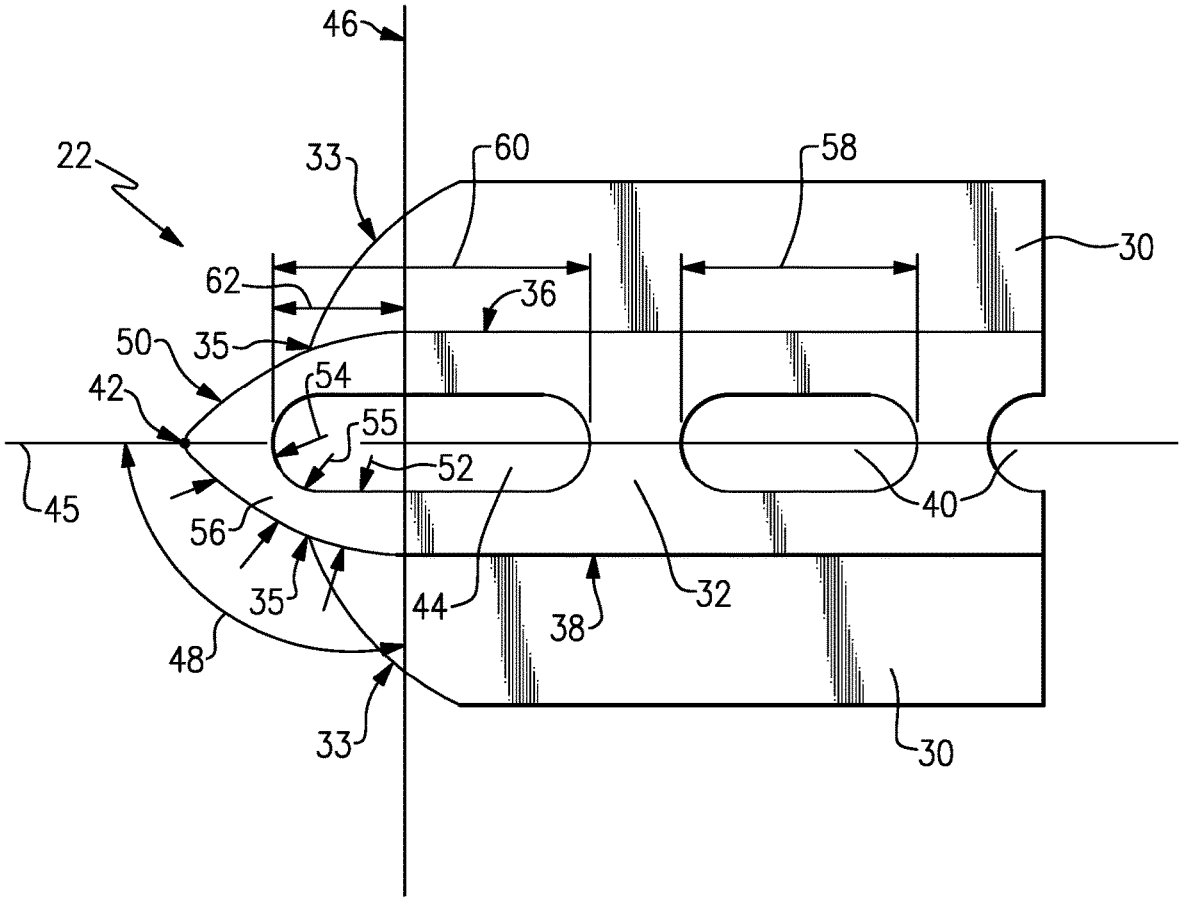
FIG. 4 is another enlarged view of the leading of edge of the cast plate.

Referring to FIG. 4 with continued reference to FIG. 3, the example plate portion 32 includes the leading edge passage 44 that extends into the leading edge 22. The example leading edge 22 includes an outer surface 50 that has a continually varying radius that decreases in a direction towards the terminal tip 42. The plate portion 32 includes a flat top surface 36 that transitions to the varying radius towards the terminal tip 42. The varying radius begins at an intersection plane 46. Beginning at the intersection plane 46 toward the terminal tip 42, the surface 50 includes the varying radius that is schematically indicated at 48. The varying radius 48 provides the desired shape of the leading edge 22 to improve survivability in the case of impact and also provides improved airflow characteristics. In the disclosed example, the radius 48 is the same between the top surface and the bottom surface 38, however, the radius may be different between top and bottom surfaces to provide an asymmetric leading edge 22 about a horizontal plane 35.

In this example the varying radius 48 maintains laminar flow characteristics of the cooling flow 20 as it flows along the top and bottom surfaces 36, 38. As appreciated other shapes may be utilized within the contemplation of this disclosure that include different varying radii that decreases towards the terminal tip 42 to provide improved air flow characteristics that maintain a laminar flow along the top and bottom surfaces 36, 38 of the plate portion 32.

The leading edge passage 44 extends forward past the intersection plane 46 into the leading edge 22. Each of the plurality of passages 40 include a common width 58. In this example embodiment the leading edge passage 44 includes a width 60 that is different than the width 58 of the other passages 40 not disposed within the leading edge 22. In this example the width 60 is greater than the width 58, however, the width 60 may be smaller to provide the desired wall thickness within the leading edge 22.

The leading edge passage 44 also includes a wall 56 within the leading edge 22 forward of the intersection plane 46. The wall 56 includes thicknesses 52, 55, and 54 that increase in a direction towards the terminal tip 42 beginning from the intersection plane 46. The increased thickness of the wall 56 in the direction towards the terminal tip 42 improves durability and survivability of the case plate 12. Although the wall thicknesses 52, 55, and 54 are shown in the disclosed example as symmetric about a horizontal plane 45, the wall thicknesses 52, 55, and 54 may vary asymmetrically about the plane 45 to provide a desired impact protection and heat transfer.

Fin portions 30 disposed on the top and bottom surfaces 36, 38 of the plate portion 32 extend past the intersection plane 46 and include a tapered edge 33 forward of the intersection plane 46 that begins aft of the intersection plane 46. The tapered edge 33 of the fin portions 30 also improves durability and airflow characteristics. Each of the fin portions 30 include a forward most end 35 that is spaced apart from the terminal tip 42. The tapered edge 33 begins at the forward most end 35 that is spaced apart from the terminal tip 42.

Figure 5:
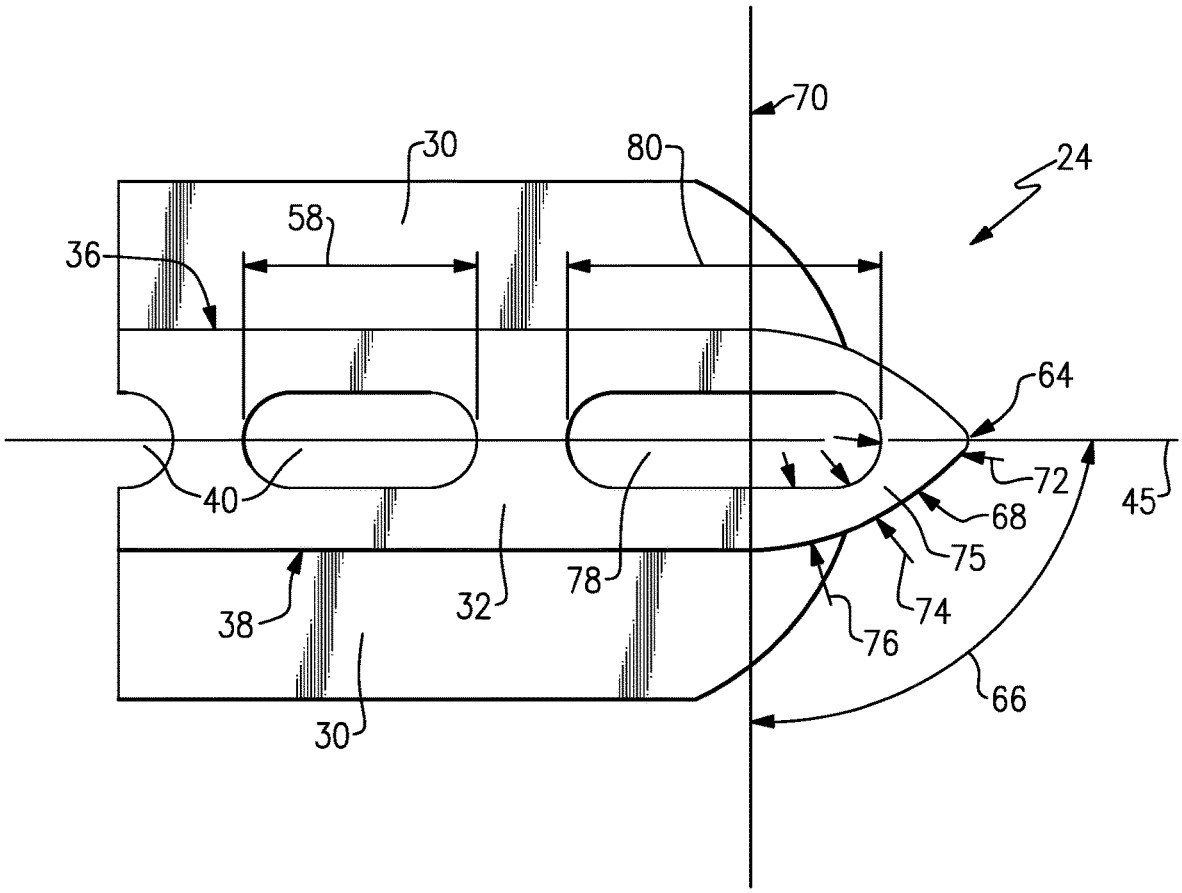
FIG. 5 is an enlarged view of the trailing edge of the example cast plate.

Referring to FIG. 5 with continued reference to FIG. 4, the trailing edge 24 of the disclosed plate 12 embodiment includes a configuration similar to that provided in the leading edge 22. The trailing edge 24 includes a trailing edge terminal tip 64. The terminal tip 64 is at the aft-most portion of the plate portion 32 such that it is last physical part of the plate 12 that encounters cooling airflow 20. A surface 68 between a trailing edge intersection plane 70 and the terminal tip 64 as indicated at 66 is a continuously varying radius. The trailing edge surface 68 includes a radius that decreases in a direction from the intersection plane 70 in a direction towards the terminal tip 64. The varying radius of surface 68 may be the same as that provided at the leading edge 22 to provide a uniformity of the plate portions 32. Alternatively, the varying radius of surface 68 may be different to provide the airflow characteristics with regard to the cooling airflow 20 flowing over the trailing edge 24.

Additionally the trailing edge 24 includes a trailing edge passage 78 which is the aft-most passage of the plurality of passages 40. In this example the trailing edge passage 78 includes a width 80 that is greater than the common width 58 of the other plurality of passages 40. Moreover the trailing edge passage 78 extends past the trailing edge intersection plane 70 into the trailing edge 24. The trailing edge 24 includes a trailing edge wall 75 with a thickness that increases in a direction towards the terminal tip 64. The wall 75 includes varying wall thicknesses 76, 74 and 72 that increase in a direction toward the terminal tip 64.

Figure 6:
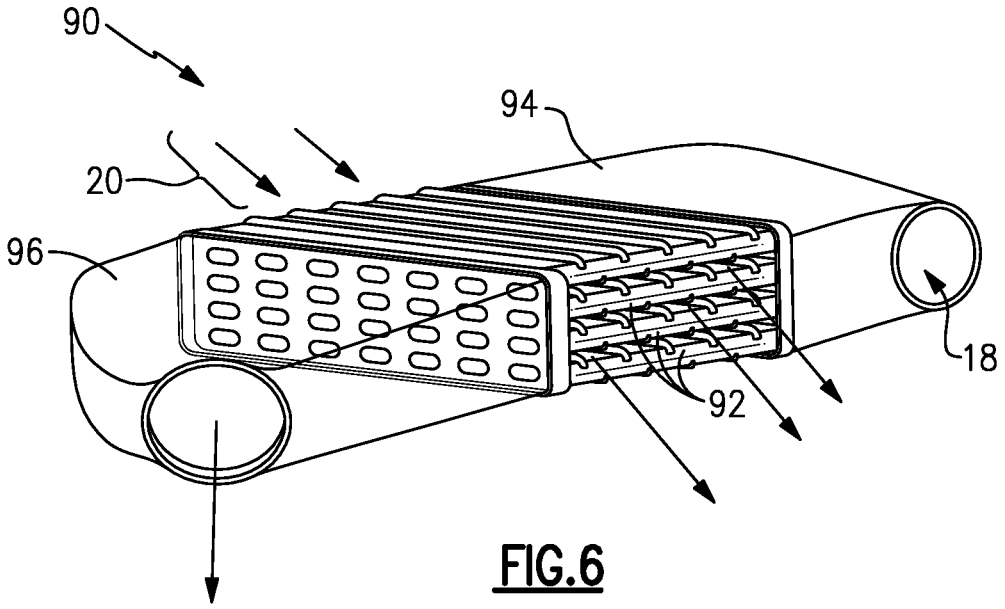
FIG. 6 is a perspective view of another example heat exchanger embodiment.

Referring to FIG. 6 another example heat exchanger assembly 90 is disclosed and includes a plate 92 that includes a plurality of plate portions 98 that are formed as a single unitary part. An inlet manifold 94 and outlet manifold 96 communicate hot airflow through the cast plate 92 in the same manner as the heat exchanger assembly 10 shown in FIG. 1.

Figure 7:
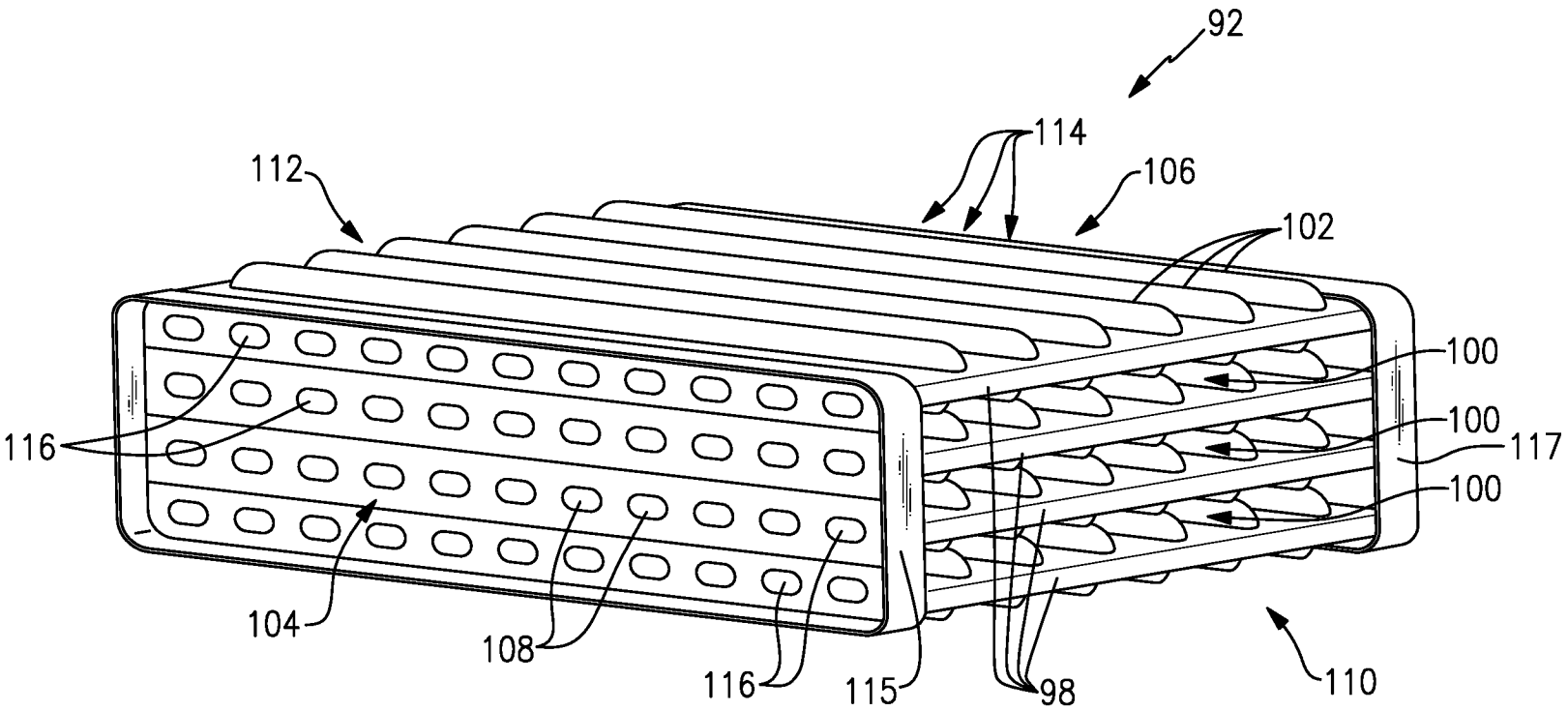
FIG. 7 is a perspective view of another cast plate embodiment.

Referring to FIG. 7 with continued reference to FIG. 6, the example plate 92 is shown in a perspective view and includes four plate portions 98 and three cooling channels 100 defined between the plate portions 98. Each of the cooling channels 100 is a space for cooling airflow 20 and includes fin portions 102. The fin portions 102 extend from top and bottom surfaces of each of the plate portions 98 to provide an increase in surface area to improve thermal transfer between the hot flow 18 and cooling airflow 20.

The example plate 92 includes a leading edge 112 and a trailing edge 110. The leading edge 112 and trailing edge 110 include the same features and configuration as is disclosed in previous FIGS. 4 and 5. Accordingly, each of the plate portions 98 includes a terminal tip 42 and a leading edge 22 wherein the leading edge 22 includes a continuously varying radius between an intersection plane and the terminal tip 42. A leading edge passage 44 extends past the intersection 46 into the leading edge 22 and a trailing edge passage 78 extends aft past an intersection 70 into the trailing edge 24. Additionally, the leading edge passage 44 and the trailing edge 24 for each of the plates 92 includes a varying wall thickness that increases in thickness in a direction toward the corresponding terminal tips 42 64.

The example plate 92 includes a plurality of plate portions 98 that each define a plurality of passages 116 that extend between a corresponding plurality of inlets 114 and outlets 108. Each of the outlets 108 open onto a common outlet face 104. The common outlet face 104 is a flat plane through which each of the outlets 108 for each of the four plate portions 98 is disposed. The outlet face 104 is surrounded by an outlet perimeter 115. Similarly, the plurality of inlets 114 open onto an inlet face 106. The inlet face 106 is similar to the outlet face 104 and includes the plurality of inlets 114 that open and are disposed within the inlet face 106 surrounded by an inlet perimeter 117.

Figure 8:
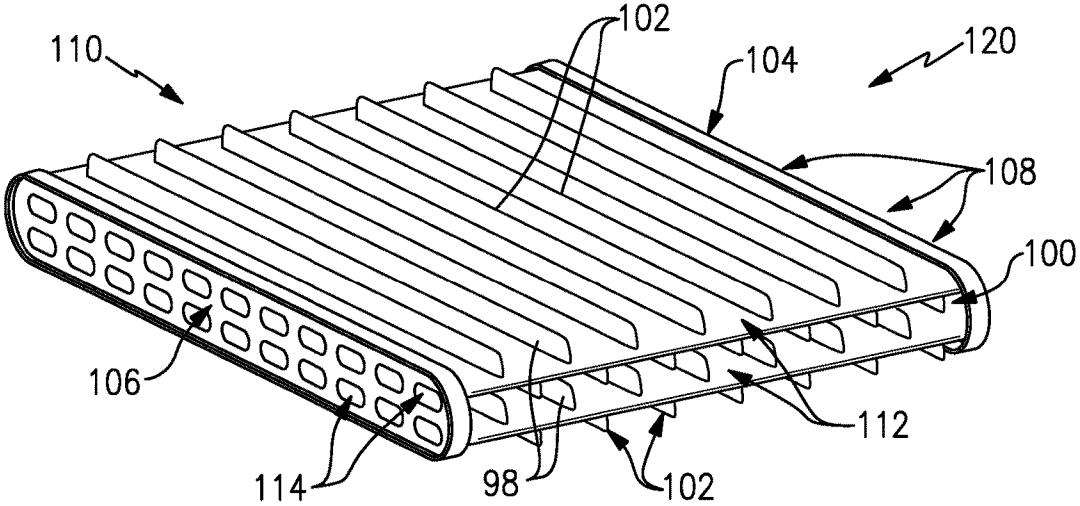
FIG. 8 is a perspective view of another cast plate embodiment.
Figure 9:
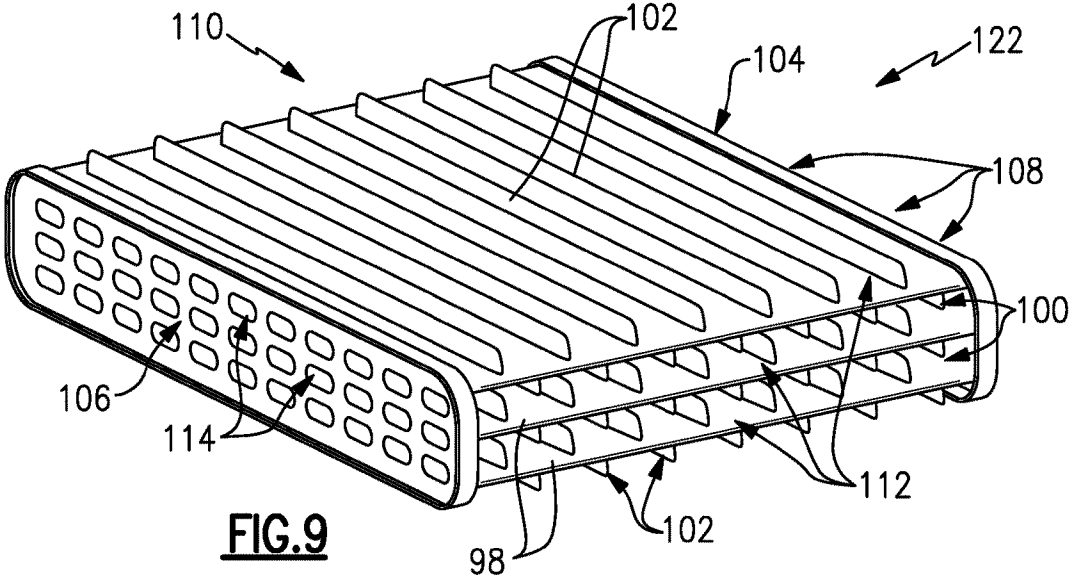
FIG. 9 is yet another perspective view of another cast plate embodiment.

Referring to FIGS. 8 and 9 additional cast plate embodiments 120, 122 are shown. FIG. 8 illustrates the plate 120 that includes two plate portions 98. FIG. 9 disclosures the plate 122 with three plate portions 98. The plate 120 includes a single cooling channel 100 disposed between the two plate portions 98. Each of the plate portions 98 include the leading and trailing edge configurations as described above in FIGS. 4 and 5.

The plate 122 disclosed in FIG. 9 includes three plate portions 98 and two cooling channels 100 disposed between the three plate portions 98. The plate portions 98 include leading edges 112 and trailing edges 110 that include the same configuration and features as disclosed and described in FIGS. 4 and 5 above. Both the plates 120 and 122 include an inlet face 106 with a plurality of inlets 114 and an outlet face 104 with a plurality of outlets 108. Each of the inlet and outlet faces 106, 104 define a common plane for the corresponding inlets 114 and outlets 108.

The example disclosed plates 12, 92 are formed as single piece unitary structure and may be formed using casting, additive manufacturing as well as traditional machining. The disclosed heat exchanger assembly include a single unitary plate portion with features on both the leading and trailing edge that improve cooling airflow, thermal transfer and survivability.

Although an example embodiment has been disclosed, a worker of ordinary skill in this art would recognize that certain modifications would come within the scope of this disclosure. For that reason, the following claims should be studied to determine the scope and content of this disclosure.

What is claimed is:

1. A heat exchanger assembly comprising:

a plate including a plate portion having a leading edge, a trailing edge, an inlet side and an outlet side, wherein the leading edge of the plate portion includes a terminal tip and a varying radius that decreases in a direction toward the terminal tip, wherein the plate portion includes a plurality of internal passages extending between a corresponding plurality of inlets on the inlet side and a corresponding plurality of outlets on the outlet side and one of the plurality of internal passages includes a leading edge passage disposed closest to the leading edge, wherein a wall thickness between the leading edge passage and the leading edge increases in a direction toward the terminal tip;

an inlet manifold on the inlet side; and an outlet manifold on the outlet side.

2. The heat exchanger assembly as recited in claim 1, including a plurality of fin portions extending outward from a top surface and a bottom surface of the plate portion, wherein each of the plurality of fin portions include a forward most end that is spaced apart from the terminal tip.

3. The heat exchanger assembly as recited in claim 2, wherein the forward most end of each of the plurality of fin portions is tapered in a direction away from the terminal tip.

4. The heat exchanger assembly as recited in claim 1, wherein the plate portion includes a top surface parallel to a bottom surface, and the varying radius tapers from both the top surface and bottom surface at an intersection point spaced apart from the terminal tip and at least one of the plurality of passages is disposed at least partially forward of the intersection point.

5. The heat exchanger assembly as recited in claim 4, including a uniform wall thickness between each of the plurality of passages and the top and bottom surfaces of the plate portion.

6. The heat exchanger assembly as recited in claim 4, wherein one of the plurality of internal passages includes a leading edge passage disposed closest to the leading edge, the leading edge passage including a width different than each of the other plurality of passages.

7. The heat exchanger assembly as recited in claim 4, wherein the plurality of passages are one of a stadium shape, elliptical shape, oval shape and rectilinear shape in cross-section.

8. A heat exchanger assembly comprising:

a plate including a plate portion having a leading edge, a trailing edge, an inlet side and an outlet side, wherein the leading edge of the plate portion includes a terminal tip and a varying radius that decreases in a direction toward the terminal tip, wherein the plate comprises a plurality of plate portions extending between a common inlet face and a common outlet face, wherein a cooling flow channel is disposed between two of the plurality of plate portions and includes fins extending from top and bottom surfaces of each of the plurality of plate portions;

an inlet manifold on the inlet side; and an outlet manifold on the outlet side.

9. The heat exchanger assembly as recited in claim 1, wherein the trailing edge includes a second terminal tip and a trailing edge surface with a varying radius that decreases in a direction toward the second terminal tip.

10. The heat exchanger assembly as recited in claim 9, including a trailing edge passage disposed at least partially aft of an intersection point between the top and bottom surfaces and the trailing edge surface.

11. The heat exchanger assembly as recited in claim 1, wherein the plate comprises a single unitary part.

12. A cast plate for a plate fin heat exchanger comprising:

a plate portion having a leading edge, trailing edge, an inlet side and an outlet side, wherein the leading edge of the plate portion includes a terminal tip and a varying radius that decreases in a direction toward the terminal tip, wherein the varying radius tapers beginning from at least one of a top surface and a bottom surface at an intersection point spaced apart from the terminal tip and at least one of a plurality of passages through the plate portion is disposed at least partially forward of the intersection point, wherein one of the plurality of passages includes a leading edge passage disposed closest to the leading edge, wherein a wall thickness between the leading edge passage and the leading edge increases in a direction toward the terminal tip.

13. The cast plate as recited in claim 12, including a plurality of fin portions extending outward from a top surface and a bottom surface of the plate portion, wherein each of the plurality of fin portions includes a forward most end that is spaced apart from the leading edge and tapered in a direction away from the terminal tip.

14. The cast plate as recited in claim 12, wherein the plurality of passages are one of a stadium shape, elliptical shape, oval shape and rectilinear shape in cross-section.

15. The cast plate as recited in claim 12, wherein the cast plate comprises a plurality of plate portions extending between a common inlet face and a common outlet face, wherein a cooling flow channel is disposed between two of the plurality of plate portions and includes fins extending from top and bottom surface of each of the plurality of plate portions.

16. The cast plate as recited in claim 12, wherein the cast plate comprises a single unitary part.

* * * * *